US005671572A

United States Patent [19]

Siller-Franco

[11] Patent Number: 5,671,572

[45] Date of Patent: Sep. 30, 1997

[54] METHOD FOR EXTERNALLY REINFORCING GIRDERS

[76] Inventor: Jose Luis Siller-Franco, Miguel Angel 78, Col. Mixcoac, Mexico D.F., Mexico, 03910

[21] Appl. No.: 385,462

[22] Filed: Feb. 8, 1995

[30] Foreign Application Priority Data

Feb. 11, 1994 [MX] Mexico ..... 941088

[51] Int. Cl.[6] ..... E04C 5/08

[52] U.S. Cl. ..... 52/223.8; 52/223.11; 52/223.13; 52/741.1; 29/897.34

[58] Field of Search ..... 52/223.11, 223.13, 52/223.14, 741, 223.6, 223.8, 223.12, 729.1; 29/897.34, 897.35

[56] References Cited

U.S. PATENT DOCUMENTS

| | | | |
|---|---|---|---|
| 1,970,966 | 8/1934 | Leake . | |
| 2,510,958 | 6/1950 | Coff | 52/223.8 |
| 2,822,068 | 2/1958 | Hendrix . | |
| 2,856,644 | 10/1958 | Dakham | 52/223.12 |
| 3,202,394 | 8/1965 | Shoe | 52/223.6 X |
| 3,427,773 | 2/1969 | Kandall . | |
| 3,505,824 | 4/1970 | White | 52/223.6 X |
| 4,006,523 | 2/1977 | Mauquoy | 29/897.34 X |
| 4,704,830 | 11/1987 | Magadini . | |
| 5,175,968 | 1/1993 | Saucke | 52/223.8 |
| 5,313,749 | 5/1994 | Conner . | |

FOREIGN PATENT DOCUMENTS

| | | | |
|---|---|---|---|
| 2545130 | 11/1984 | France | 52/223.13 |
| 0051064 | 1/1911 | Switzerland | 52/223.8 |
| 1004567 | 3/1983 | U.S.S.R. | 52/223.13 |

*Primary Examiner*—Carl D. Friedman
*Assistant Examiner*—Winnie Yip
*Attorney, Agent, or Firm*—Darby & Darby

[57] ABSTRACT

The load bearing capacity of girders, particularly those already installed in bridges, may be increased by providing, on each face of the girder, an external reinforcement which comprises a tension member divided into three stretches, namely a first stretch extending downwardly from the upper corner of the web adjacent the upper flange at one end of the girder and a first point of the lower edge of the lower flange of the girder at a predetermined distance from said one end a second stretch extending horizontally from said first point to a second point of the lower edge of the lower flange of the girder at a predetermined distance from the opposite end of the girder, and a third stretch extending upwardly from said second point to the upper corner of the web adjacent the upper flange at the opposite end of the girder, connecting the ends of said tension member stretches exclusively by means of friction forces to the girder, and either simultaneously or independently tensing said tension member stretches in order to provide an increased strength of the girder to bending stresses and/or shearing stresses.

22 Claims, 11 Drawing Sheets

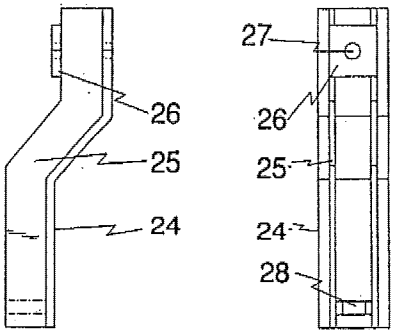
Fig. 18A
Fig. 18B
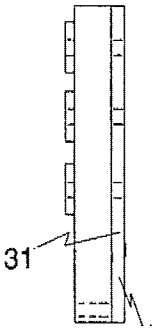
Fig. 19A
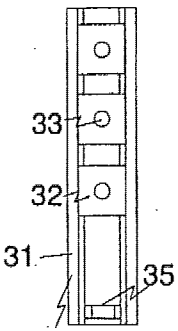
Fig. 19B
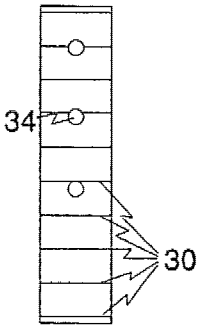
Fig. 19C
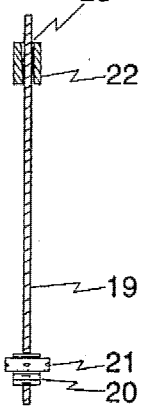
Fig. 21A
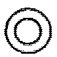
Fig. 21B
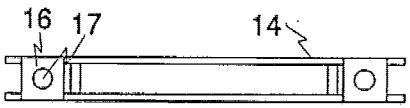
Fig. 20C
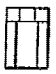
Fig. 20B
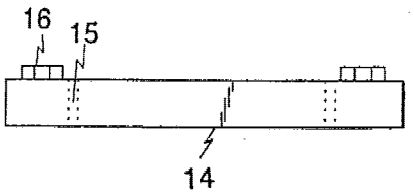
Fig. 20A

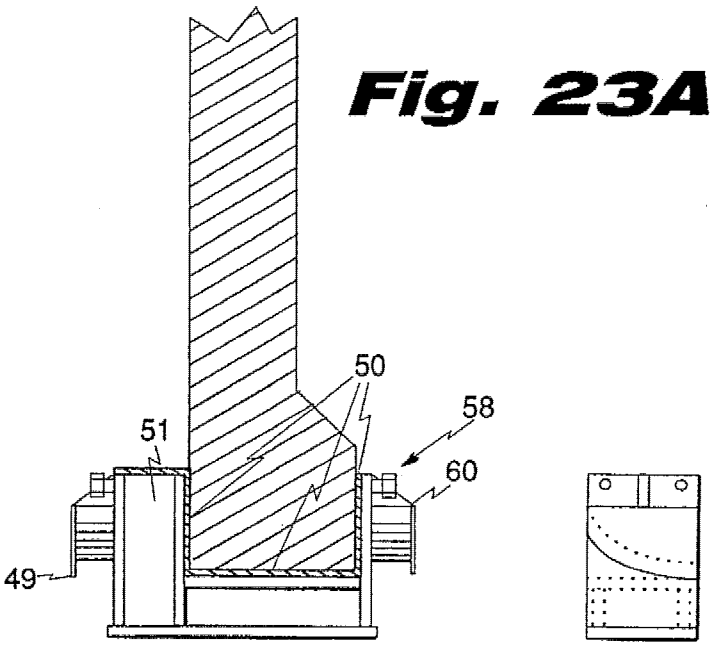
Fig. 23A
Fig. 23B
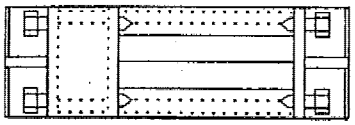
Fig. 23C
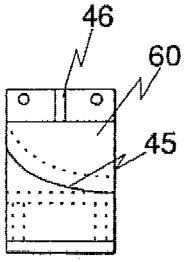
Fig. 22B
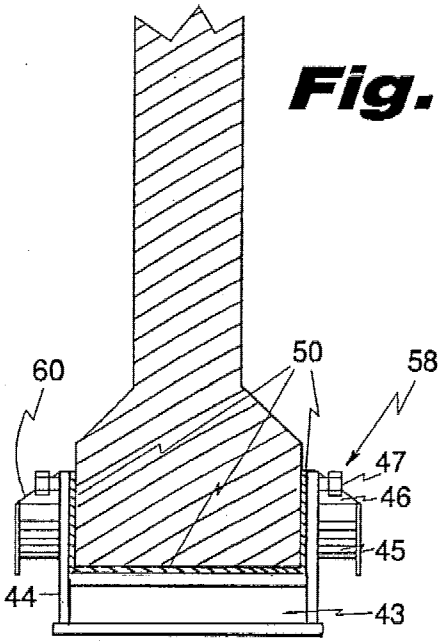
Fig. 22A
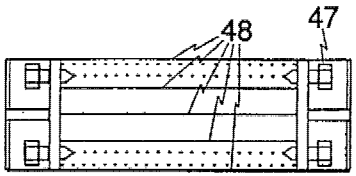
Fig. 22C

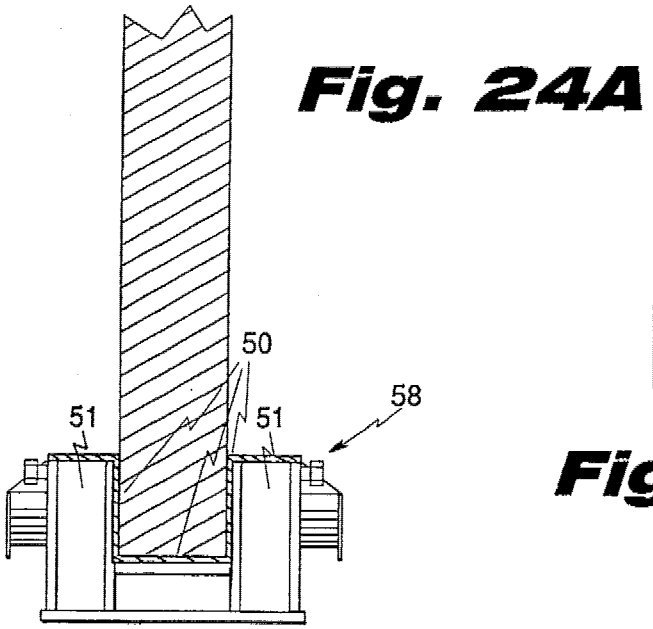
Fig. 24A
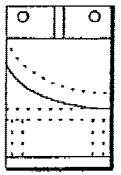
Fig. 24B
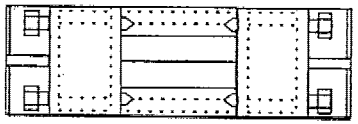
Fig. 24C
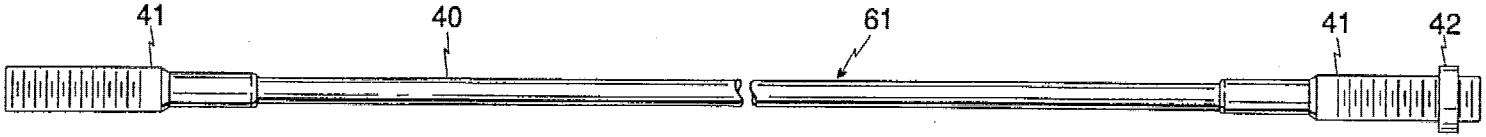
Fig. 25A
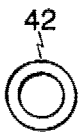
Fig. 25B
Fig. 25C

METHOD FOR EXTERNALLY REINFORCING GIRDERS

FIELD OF THE INVENTION

The present invention refers to the reinforcement of girders for increasing the load bearing capacity thereof and, more particularly, it is related to a method for externally reinforcing concrete girders for bridges in order to increase the load bearing capacity thereof, without the need of interrupting the traffic therethrough.

BACKGROUND OF THE INVENTION

Methods and systems for externally reinforcing beams and girders, which are obviously also applicable to beams and girders for bridges, are known in the prior art. For instance, U.S. Pat. No. 1,970,966 patented on Aug. 31, 1934 to Arthur G. Leake discloses a method of reinforcing beams and girders under load which essentially comprises incorporating a flat member or plate under the lower flange of an I beam or the like, by firstly welding the plate to the flange at the longitudinal center thereof so that the plate expands with the heat developed by the welding operation until the total length of the plate matches a predetermined length which is marked by means of stops or markers located at a distance from each end of the plate. When the plate has expanded enough to permit its ends to abut the said markers, both ends of the plate are welded to the flange. In this manner, the reinforcing plate will be prestressed when cooled in order to strengthen the load bearing capacity of the beam or girder. Although this method accomplishes the goal of strengthening the beam, it is of very difficult control as to the length to be acquired by the reinforcing member and requires multiple welds starting from the longitudinal center thereof when the length of the plate is sufficient large not to be uniformly heated by one single weld. The prestress obtained when the plate cools down, on the other hand, is practically impossible to be uniformly distributed along the length of the reinforcing plate and, finally, this may be considered as an extremely inflexible method that cannot be adjusted once it is completed.

In U.S. Pat. No. 2,822,068 patented on Feb. 4, 1958 to Hubert I. Hendrix, a method for applying tension to a beam structure in order to reverse the stress therein is disclosed. In this method, Hendrix applies a longitudinal steel rod running parallel to the lower flange on each side of a beam and adjacent said lower flange. The rods are anchored at one end of the beam by means of respective saddle brackets and tension is applied on said rods at the opposite ends thereof and then said other ends are anchored to the respective beam. The tension may also be provided by bending the rods upwardly at the supported points of the beam until the required tension is obtained and then the uppermost portions of the bent section ape anchored to the beam by means of further saddle brackets. This method, although accomplishing the goal of stressing the beam against bending and some shearing stresses, must be considered as of permanent installation, that is that once it is mounted on the beam, no adjustments can be made thereto when the tension rods begin to suffer fatigue due to continuous use particularly due to the fact that the saddle brackets used are not suitable to permit a true sliding of the rods and on the other hand said system may be considered as relatively unsafe because said brackets are mounted on the beam by means of bolts or the like, to which enormous shearing stresses are constantly applied by the tension of the reinforcing rods.

Charles Kandall in U.S. Pat. No. 3,427,773, patented on Feb. 18 1979, describes a structure for increasing the load carrying capacity of a beam, which essentially comprises an independent compression member or bar slidably arranged along the sides of the web of the beam and running parallel thereto near the upper flange of the beam, a tension member or tendon such as a rod attached to the ends of said independent compression member such that the tension forces exerted by said tension member be fully taken by said compression member and not transmitted to the beam, said tension member or tendon being threaded through a plurality of saddle brackets or supports integral with the beam, the mid portion of said tension member being near the lower flange of the beam and the ends of said tension member being at the same level as the ends of the compression member. With this system, when the beam tends to bend, the tension rod will transmit directly to the said beam an upwardly directed compensating force through said saddle brackets, whereas when the beam is at rest, all the upward force exerted by said tension member will be taken by the compression member, thus avoiding upward bending of the beam. The structure of Kandall, however, is of a rather complex nature and the provision of the compression member considerably adds to the dead weight of the whole structure, thus partially defeating the purpose of increasing the load bearing capacity of the beam. On the other hand, said compression member cannot have a considerable length, since then it would practically constitute a second beam in itself. Therefore, this structure does not appear to be a practical solution for the problem.

U.S. Pat. No. 4,704,830 patented on Nov. 10, 1987 to Charles R. Magadini, discloses a method of reinforcing an I beam for increasing the load bearing capacity thereof, which essentially comprises removing the concrete from the ends and the mid portion of the beam, placing a transverse load bearing plate under the lower flange of the beam said load bearing plate having a saddle member attached by means of a bolt in order to slidably accommodate a tension member such as a chain or cable said tension member being hooked to the upper flange of the beam at the two ends thereof. This system is only capable of use in connection with relatively small loads, such as in girders for homes and the like, and is not suitable for use with bridges where the load bearing capacities are relatively large.

Mitchel R. Conner, in U.S. Pat. No. 5,313,749, patented on May 24, 1994, discloses a beam reinforcing structure which comprises a longitudinal force transmitting member attached to the lower edge of the beam (by welding or the like), a box or the like attached under said force transmitting member, said transmitting member and box extending along the length of the beam and said box having a compression plate on each end thereof, and one or more tensioned members or rods attached to each compression plate and extending along the full length of said transmitting member and box, whereby to form a prestressed beam for use in the building arts. Although the structure of Conner accomplishes the goal of reinforcing a beam and increasing the load bearing capacity thereof, it is quite clear that such a structure must be attached to the beam prior to the use thereof as a prestresses beam and is not applicable to the reinforcement of beams already in use in bridges or the like.

Other relatively broadly used techniques for reinforcing or repairing girders or beams for bridges and the like are those applied to the reinforcement of bridges of the freely supported span type. These techniques generally comprise breaking the traffic running surfaces of the bridge at the places where the girder heads are located in order to fill with concrete the spaces normally left between the same so as to form a monolithic structure. Then a tendon or tension member is installed on each side of each girder, such that said tendons form angled stretches by successively passing over the top plane of the supporting diaphragms and under the lower plane of the intermediate supporting diaphragms to which an extension is added so as to support the tendon which runs exteriorly thereof. Then the ends of said tendons ape anchored and tensed against buried anchoring blocks placed behind the diaphragms of the buttresses, and the tendons are protected with a polymer sheath which is thereafter injected with concrete. These techniques, as those already described in the above discussed references, are rather costly and require the interruption of the traffic through the bridge, whereby they do not constitute a practical solution to the reinforcement and repair of existing bridges.

Finally, applicant has described, in co-pending U. S. patent application Ser. No. 07/998,480, a novel type of friction connectors for reinforcing tendons, which solve the problem of transmitting the forces exerted by said tendons to the beam or girder, which friction connectors are fully applicable in the structures of the present invention.

OBJECTS OF THE INVENTION

Having in mind the defects of the prior art structures for increasing the load bearing capacity of girders or beams, it is an object of the present invention to provide a system for reinforcing girders, particularly for use in bridges, which will be of a very simple construction and yet of a great efficiency to accomplish the goal increasing the load bearing capacity of the bridges.

Another object of the present invention is to provide a system for reinforcing girders, of the above mentioned character, particularly for use in bridges, which will not reduce the vertical clearance of the bridge and will not require the interruption of the traffic during installation.

One other object of the present invention is to provide a method for reinforcing girders, particularly for use in bridges, which will increase the load bearing capacity thereof by the addition of external stress transmitted exclusively by friction to the girders.

Another object of the present invention is to provide a method for reinforcing girders, of the above mentioned character, which will be capable of increasing the strength thereof both to bending and shearing stresses.

An additional object of the present invention is to provide a method for reinforcing girders, of the above identified character, particularly for use in bridges, which will be capable of increasing the load bearing capacity of already prestressed bridges that will not admit further longitudinal prestressing of the girders thereof.

One other object of the present invention is to provide a method for reinforcing girders, of the above discussed character, particularly for use in bridges, which will enable the provision of independent and different degrees of reinforcement along the length of the girders thereof.

Still one other object of the present invention is to provide a method for reinforcing girders, of the above mentioned character, particularly for use in bridges, which will permit the compensation of negative bending of continuous beams used for the construction of said bridges, under zero load conditions, simultaneously with the increase in the strength of said continuous beams both to shearing and to positive bending stresses.

The foregoing objects and others ancillary thereto are preferably accomplished as follows According to a preferred embodiment of the present invention, a method of reinforcing girders, particularly for use in bridges, said girders including a web, an upper or compression flange and a lower or tension flange, comprises attaching exclusively by friction forces to each one of the two faces of said web, first friction connector means which extend from the upper corner of each end of the web of the girder in a downward direction towards the center of the length of the girder, attaching exclusively by means of friction forces, to said lower flange, second friction connector means in a position such that they will be collinearly arranged with respect to said first friction connector means, attaching exclusively by means of friction forces, to said lower flange, third friction connector means having a direction parallel to said lower flange, passing a tension member through said first, second and third friction connector means on one end of the girder and through said third, second and first friction connector means on the opposite end of the girder, thereby forming three tension member stretches, namely, a first stretch extending in a downwardly inclined direction between said first end said second friction connector means at said one end of the girder, a second stretch extending in a horizontal direction between said third friction connector means at said one end of the girder and said third friction connector means at said opposite end of the girder, and a third stretch extending in an upwardly inclined direction between said second and said first friction connector means at said opposite end of the girder, and tensing at least one of said tension member stretches sufficiently to transmit exclusively by means of friction forces the required upwardly directed force to said girder in order to increase the load bearing capacity thereof.

Said stretches of the tension member may be constituted by separate bundles of cables or may be a continuous bundle of cables spanning the whole length of the girder between said first friction connector means at each end of the girder, in which latter case said second and third friction connector means are combined into a guide type friction connector device to permit the guided passage of said continuous bundle of cables therethrough.

When continuous beams having multiple supports are to be reinforced, a fourth horizontally directed friction connector means is attached exclusively by friction forces to the upper portion of the web of the continuous beam at a predetermined distance to the left of each support, a fifth horizontally directed friction connector means is attached also exclusively by friction forces to the upper portion of the web of the continuous beam at the same predetermined distance to the right of each support, a tension member or tendon is placed between said fourth and fifth friction connector means, and said tension member is tensed in order to compensate for negative bending stresses in the continuous beam.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments when read in connection with the accompanying drawings, in which:

FIGS. 18A and 18B are respectively front elevational and side elevational views of a clamp for fastening the friction connectors to a bulb-type lower flange of a girder.

FIGS. 19A, 19B and 19C are respectively front elevational, front elevational and bottom plan views of a clamp for fastening the friction connectors to the lower edge of a T type girder.

FIGS. 20A, 20B and 20C are respectively front elevational, side elevational and plan views of one of the pressing members for the lower contact plates of friction connectors built in accordance with the present invention.

FIGS. 21A and 21B are respectively plan and elevational views of a fastening element for the tension members.

FIGS. 22A, 22B and 22C are respectively front elevational, side elevational and plan views of a guide-type friction connector for use with a bulb-type lower flange of a girder.

FIGS. 23A, 23B and 23C are respectively front elevational, side elevational and plan views of a guide-type friction connector for use with a semibulb-type lower flange of a girder.

FIGS. 24A, 24B and 24C are respectively front elevational, side elevational and plan views of a guide-type friction connector for use with e T type girder.

FIG. 25 is a view of a tension member for use with the bridge reinforcing system of the present invention.

DETAILED DESCRIPTION

Figure 1:
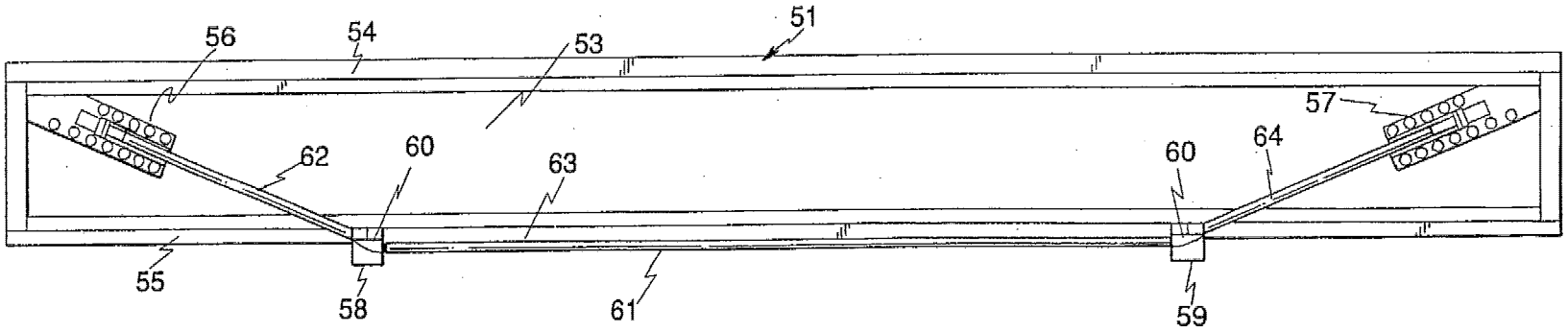
FIG. 1 is a diagrammatic side elevational view of a freely supported girder showing an external reinforcing system in accordance with a first embodiment of the present invention.

Having now more particular reference to the drawings and more specifically to FIGS. 1 to 10 thereof, the external reinforcement system of the present invention is shown in combination with a concrete girder 51, although it must be understood that said reinforcing system can also be used with any other type of girders or beams, particularly any one of those applicable to the construction of bridges.

FIGS. 1 and 5 to 7 show a girder 51 which comprises a web 53, an upper flange 54 and a lower flange 55. An inclined friction connector 56 which will be described in more detail hereinafter is attached by means of a friction fit to the left upper corner of the web 53 of the girder 51 and another identical friction connector 57 is symmetrically attached to the right upper corner of the web 53 of girder 51. A pair of symmetrically identical guide-type friction connectors 58 and 59 are attached to the lower face of the lower flange 55 of girder 51, each one of said connectors having a guide block 60 to permit the guided passage of a tension member generally identified under reference numeral 61 under the same, in order to permit tensioning of said tension member to the desired degree. The tension member 61, in the arrangement shown in FIG. 1, forms three stretches, namely, two symmetrically inclined stretches 62 and 64 between the friction connectors 56, 58 and 57, 59 and one intermediate horizontal stretch 63 between the lower friction connectors 58 and 59. It is to be noted that the above described arrangement is applied on both faces of the web 53 and flange 55 of the girder 51, as more clearly shown in FIGS. 5 to 10.

Figure 2:
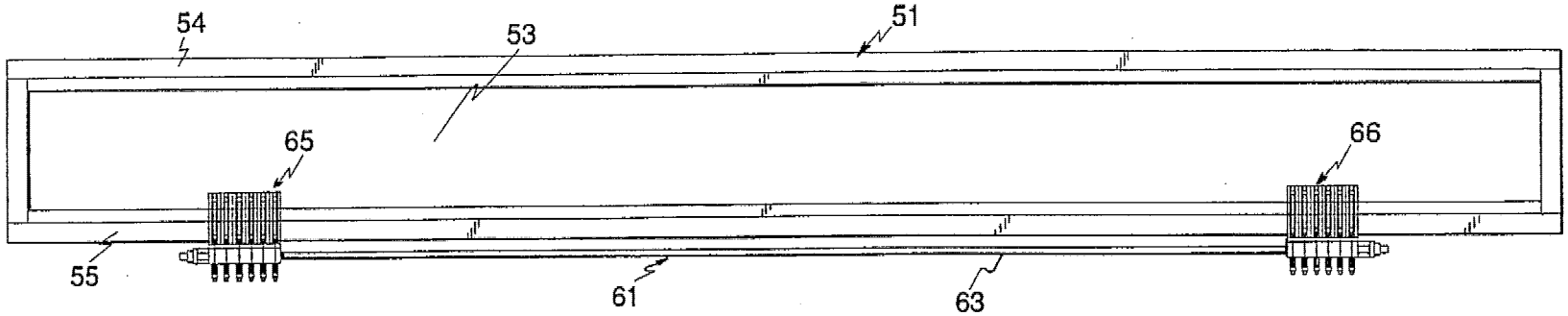
FIG. 2 is a view similar to FIG. 1, but showing the girder with an external reinforcing system in accordance with a second embodiment of the present invention.
Figure 8:
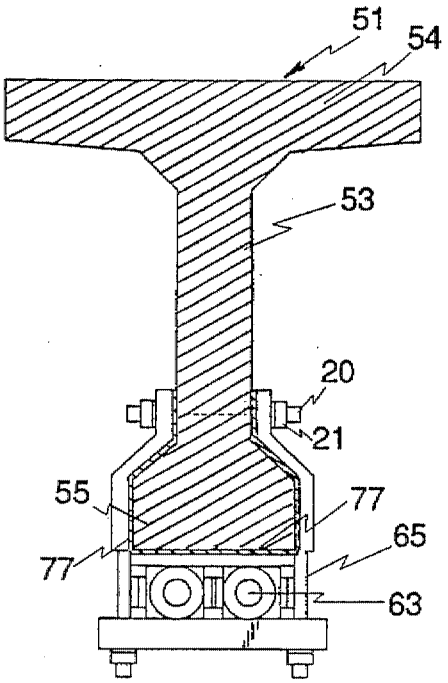
FIG. 8 is a cross sectional elevational view of the girder of FIG. 2 a lower friction connector used with a bulb-type lower flange.
Figure 9:
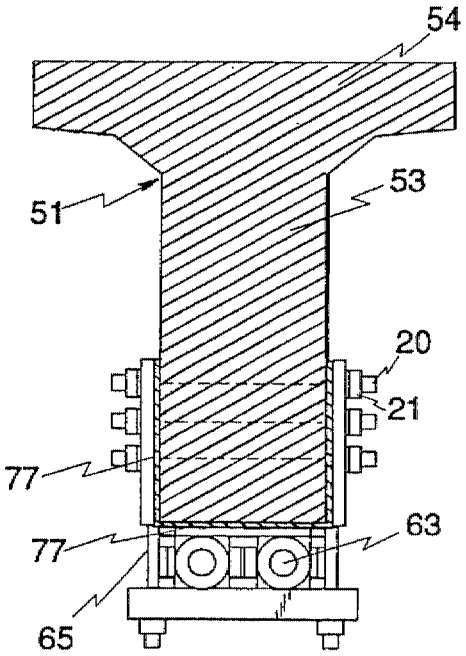
FIG. 9 is a view similar to FIG. 8 but showing the lower friction connector used with a T type girder.

In the above described embodiment of the invention, the friction connectors 58 and 57 serve as anchoring devices for the tension member 61, whereas the friction connectors 58 and 59 serve as guides for arranging said tension member 61 in the form of a "violin string". With this arrangement, the system of the present invention increases the strength of the girder both to shearing stresses and to bending stresses, inasmuch as the inclined stretches 62 and 64 of the tension member 61 apply an ascending force which compensates shearing stresses, whereas the horizontal stretch 63 of tension member 61 applies compression below the lower flange 55 of the girder and increases the strength of the same to bending stresses.

Where no increase in the strength of the girder against shearing stresses is required, the inclined stretches of the tension member 61 are removed from the system of the present invention as shown in FIGS. 2, 8 and 9, wherein girder 51 is provided with a pair of horizontal friction connectors 65 and 66 attached by friction forces to the lower flange 55, said friction connectors serving as anchoring devices for the tension member 61 which, as mentioned above, comprises only the horizontal stretch 63 which is tensed to the desired degree to increase the strength of the girder to bending stresses only.

Figure 3:
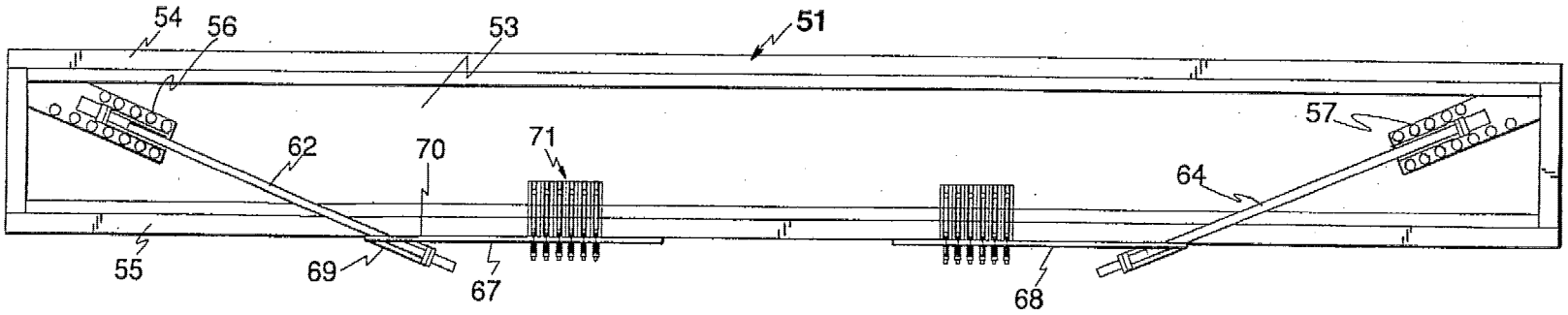
FIG. 3 is a view similar to FIG. 1, but showing the girder with an external reinforcing system in accordance with a third embodiment of the present invention.

When the girders of a bridge are longitudinally prestressed elements which will not permit the addition of more prestressing in the horizontal direction without developing a negative bending action at zero load, the horizontal stretch of the tension member 61 cannot be incorporated and then only the two symmetrically inclined stretches 62 and 64 of the tension member 61 are installed as shown in FIG. 3. As clearly shown in said figure of the drawings, the inclined upper friction connectors 56 and 57 must still be installed on the upper corners of the web 53 at each end of the girder, but the guide-type friction connectors 58 and 59 are replaced with a pair of anchoring inclined friction connectors 67 and 68 having inclined anchoring members 69 to anchor the lower end of the inclined stretches 62 or 64 of the tension member, said inclined anchoring member 69 being integrally attached below a horizontal friction plate 70 which is fastened to the lower flange 55 of the girder by means of a clamping device 71 as clearly shown in the left end of FIG. 3 of the drawings. By this arrangement, the system of the present invention will be capable of increasing the strength of the girder against shearing stresses without increasing the strength of the same to bending stresses, thus resulting in an increase in the load bearing capacity of the previously longitudinally prestresses girder.

Figure 4:
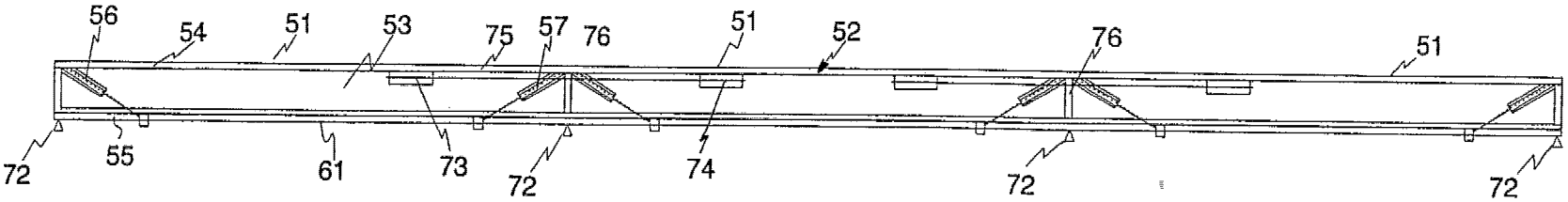
FIG. 4 is a diagrammatic side elevational view of a continuous beam having four supports and three spans, showing an external reinforcing system capable of compensating for negative bending stresses, in accordance with a fourth embodiment of the present invention.
Figure 5:
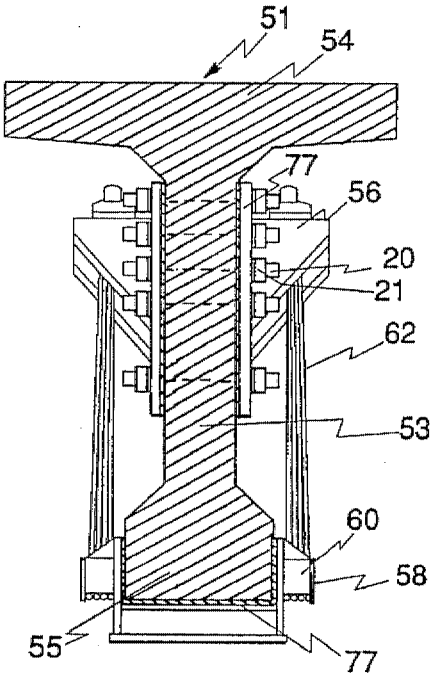
FIG. 5 is a cross sectional elevational view of one end of the girder of FIG. 1 showing the type of lower guiding friction connector used in connection with a bulb-type lower flange.
Figure 6:
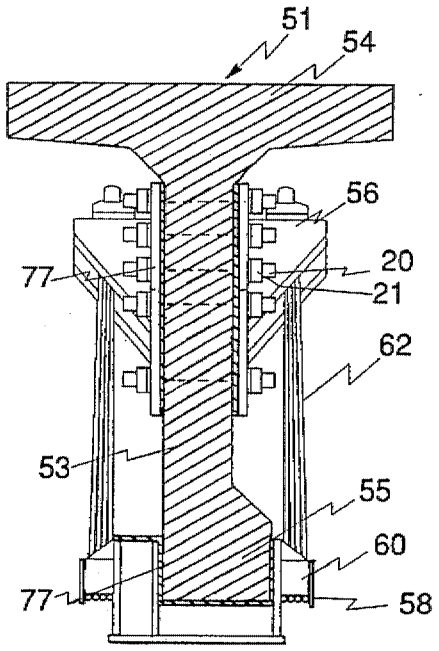
FIG. 6 is a view similar to FIG. 5 but showing the type of lower friction connector used in connection with a semibulb-type lower flange.
Figure 7:
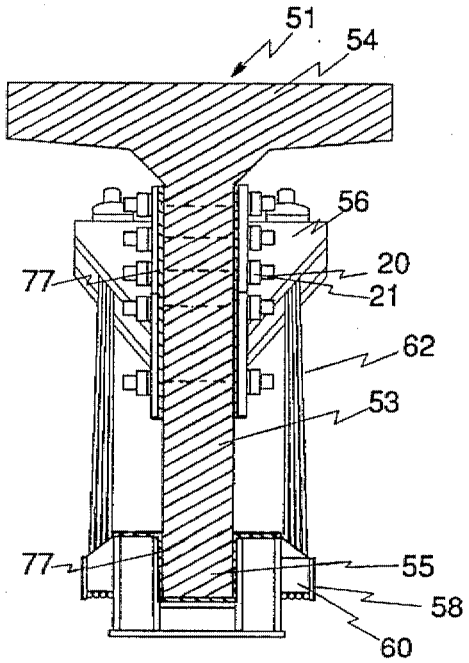
FIG. 7 is a view similar to FIG. 5 but showing the type of lower friction connector used in connection with a T type girder.
Figure 10:
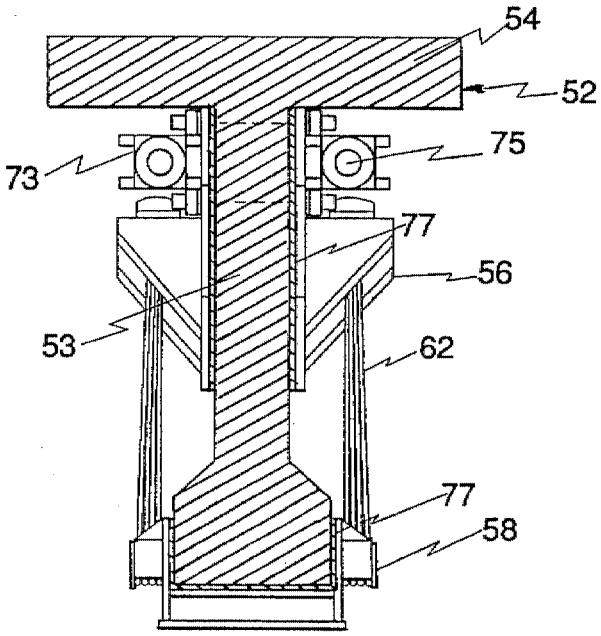
FIG. 10 is a cross sectional elevational view of the continuous beam of figure showing the upper, inclined and lower friction connectors used therewith.
Figure 11A:
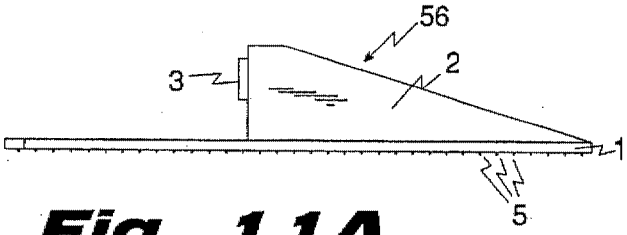
FIGS. 11A, 11B, 11C and 11D are respectively side elevational, front elevational, top plan and bottom plan views of an inclined upper friction connector or anchoring device built in accordance with the present invention.
Figure 11B:
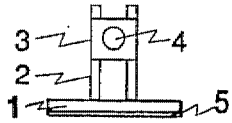
Figure 11C:
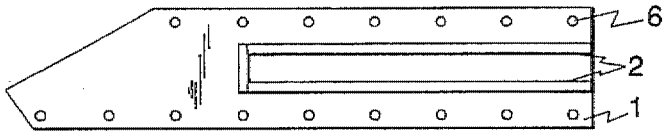
Figure 11D:
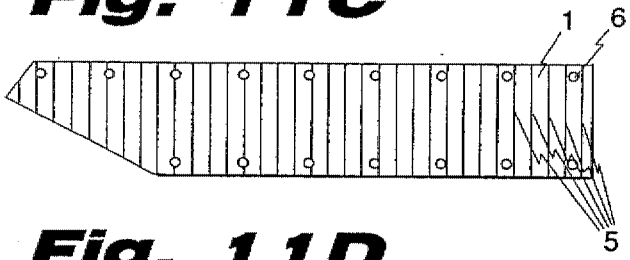
Figure 12A:
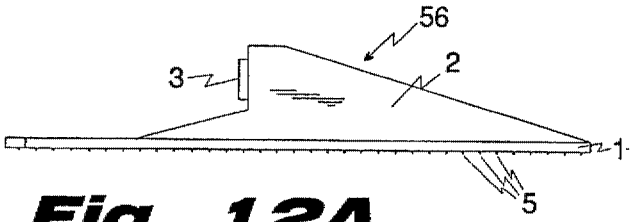
FIGS. 12A, 12B, 12C and 12D are respectively side elevational, front elevational, top plan and bottom plan views of an inclined upper friction connector or anchoring device built in accordance with the present invention for use with longer tension members.
Figure 12B:
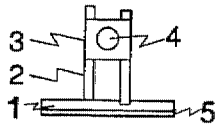
Figure 12C:
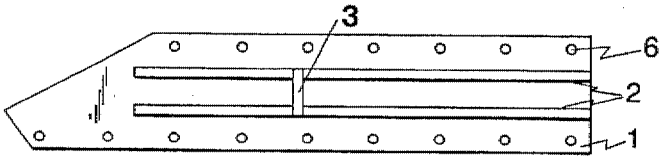
Figure 12D:
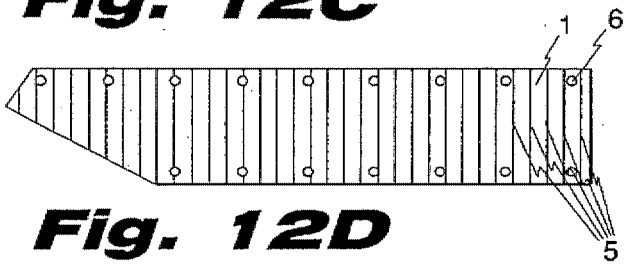
Figure 13A:
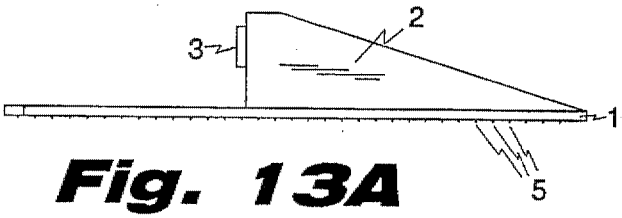
FIGS. 13A, 13B, 13C and 13D are respectively side elevational, front elevational, top plan and bottom plan views of an inclined upper friction connector or anchoring device built in accordance with the present invention for use with beams having a relatively narrow web.
Figure 13B:
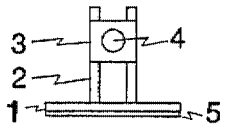
Figure 13C:
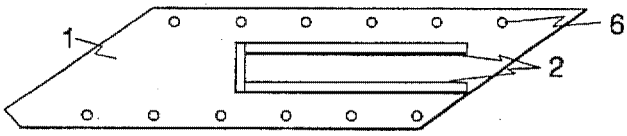
Figure 13D:
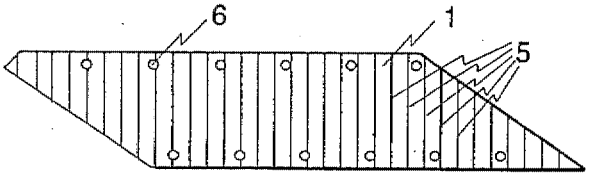
Figure 14A:
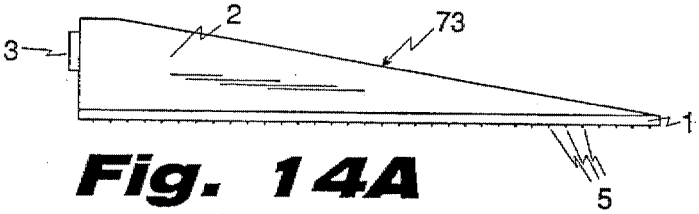
FIGS. 14A, 14B, 14C and 14D are respectively side elevational, front elevational, top plan and bottom plan views of a horizontal upper friction connector used to compensate the negative bending stresses in continuous beams.
Figure 14B:
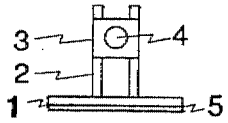
Figure 14C:
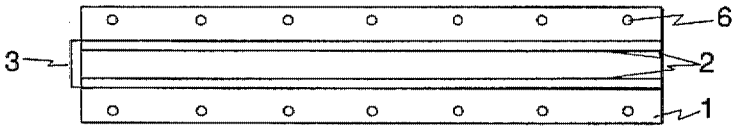
Figure 14D:
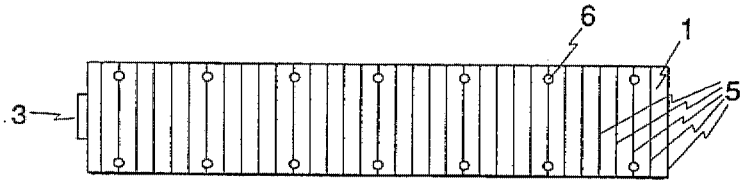
Figure 15A:
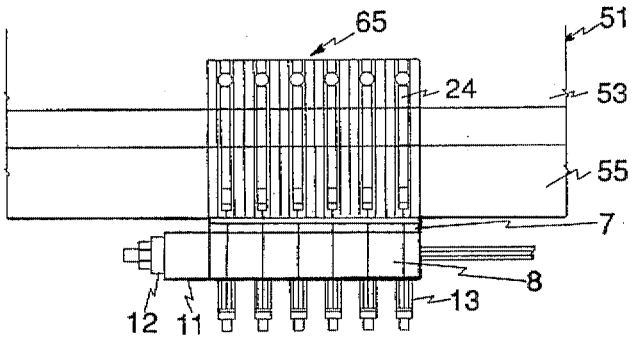
FIGS. 15A, 15B, 15C and 15D are respectively side elevational front elevational, bottom plan and top plan views of a lower horizontal friction connector used for attachment to the lower bulb-type flange of a girder for anchoring horizontal tension members.
Figure 15B:
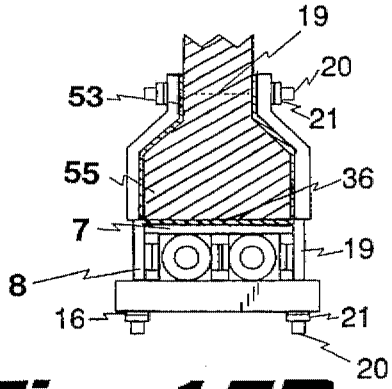
Figure 15C:
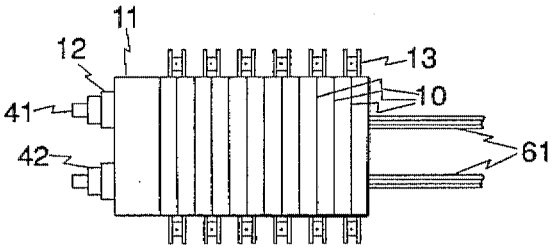
Figure 15D:
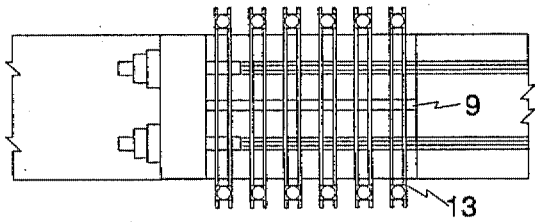

It will be clearly seen from the description of the embodiments of FIGS. 2 and 3 that said embodiments can be easily combined in order to provide a reinforcing system capable of applying independent and different tensions in the inclined and in the longitudinal directions. In order to accomplish the above goal, the clamping devices 71 are built exactly with the same construction already described for the lower friction connector 65, whereby a horizontal or longitudinally directed tension member 63 may be anchored between the two clamping devices 71 and tensed independently of the inclined tension members 62 and 64. This combined system permits to apply, for instance, a slight tension in the longitudinal direction to moderately increase the strength of the girder to bending stresses without creating negative bending when at zero load, and high tensions in the inclined tension members to generate a vertical force which will compensate for high shearing stresses applied on the girder. FIGS. 4 and 10 show a continuous beam comprising three identical girders 51 supported by any type of supports 72 and having clearances 76 between each pair of girders. In this type of continuous beams, it is frequent to encounter problems due to negative moments applied to the beam at the points of support. In order to compensate for said negative moments, the reinforcing system of the present invention is applied to each one of the girders 51 forming the continuous beam 52, but an additional tensing system is also installed horizontally on each face of the webs 53 of contiguous girders to span the point of support 72.

As shown in FIG. 4 of the drawings, each girder is provided with the reinforcing system built in accordance with the embodiment shown in FIG. 1 (although said girders may also contain any one of the embodiments of FIGS. 2 or 3 or the combination thereof without departing from the spirit of the present invention), and in addition, horizontal friction connectors 73 and 74 ape attached by means of friction forces to the upper portion of the web or the girder, one on each contiguous girder, and a tension member 75 is arranged between said connectors and tensed to the desired degree in order to compensate for said negative moments applied to the continuous beam.

All of the friction connectors generally described above are fastened to the girder by means of bolt and nut assemblies 20, 21 which pull together corresponding friction connectors on opposite faces of the girder, and thereby provide the normal force required to create the friction force which maintains the friction connectors in place vertically. The friction connectors are provided with facing plates with a harsh, rough and strongly frictioning surface, and the matching surfaces of the girder are bushhammered to also provide a high friction coefficient, in order to secure that the attachment of said friction connectors to the girder be exclusively effected by friction forces, thus avoiding any noticeable shearing stress to be applied on the bolt and nut assemblies 20, 21. In order to still increase the friction coefficient, an intermediate layer of mortar 77 in the plastic state is applied between the confronted surfaces described above, preferably with a thickness of from about 8 to about 12 mm. The mortar for use in this junctions 77 preferably is a plastic mortar with a high content of hydraulic cement, sand and any commercial additive having expansive properties and a high strength to shearing stresses, whereby when pressing the surfaces against each other with sufficiency force by means of the bolt and nut assemblies 20, 21, a joint acting exclusively by friction will be produced, such that forces provided by bolt and nut assemblies 20, 21 are substantially limited to horizontal forces that provide the required normal forces for creating the friction necessary to secure the attachment of the friction connectors to the girder exclusively by friction, and any vertical forces from bolt and nut assemblies 20, 21 are virtually annulled by the vertically directed friction forces.

Although the different friction connectors and other structural elements of the reinforcing system in accordance with the present invention may be built in any suitable manner provided that each one of them complies with the conditions already defined above according with preferred embodiments of the invention said elements are preferably built as will be described hereinbelow, Firstly, it is to be pointed out that all the friction connectors used in the reinforcing system of the present invention as anchoring devices and shown in FIGS. 11 to 14, include a friction plate 1 having a plurality of transverse ribs 5 to render its contact face sufficiently rough to provide the above described friction joint with the girder when embedded in the mortar, and a plurality of bores 6 for passing the bolts 20 of the bolt and nut assemblies used to fix the same by pressure against the girder. On the other face of the friction plate 1 a pair of parallel supporting plates 2 are integrally fastened such as by welding, said supporting plates 2 being perpendicular to and extending along the length of the friction plate 1, said supporting plates 2 having a front edge that is perpendicular to the friction plate 1. Between the front edges of said pair of supporting plates an anchoring plate 3 is welded such that a box is formed leaving sufficient space to permit the insertion of the tensioning saddle used for tensing the tension members. Anchoring plate 3 is provided with a center hole to permit the passage of the tendons and to serve as an anchor for the nut for fixing said tendons in the system of the present invention. The supporting plates 2 may adopt different forms and dimensions to satisfy the specific needs of the system and thus, for instance, a relatively long plate as shown in FIG. 11 may be used in the majority of the cases for inclined anchoring devices such as those shown in FIG. 1. However, if an additional length for the tendons is desired, supporting plates having a recessed front end such as shown in FIG. 12 may be used. If the width of the web of the girder is small then short supporting plates such as shown in FIG. 13 may be used. Finally for horizontal anchoring devices such as those shown in FIG. 4, relatively long supporting plates such as those shown in FIG. 14 may be used.

Figure 16A:
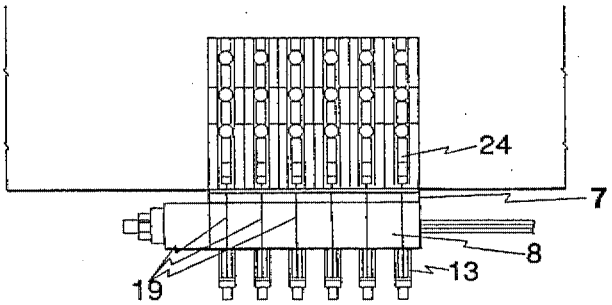
FIGS. 16A and 16B are views similar to figures 15A and 15B of a lower horizontal friction connector for use with a T type girder.
Figure 16B:
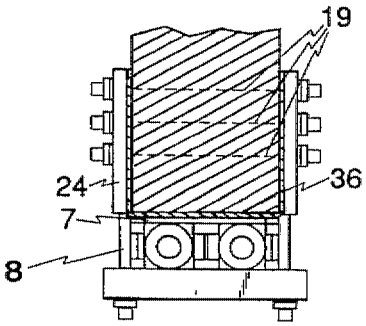
Figure 17A:
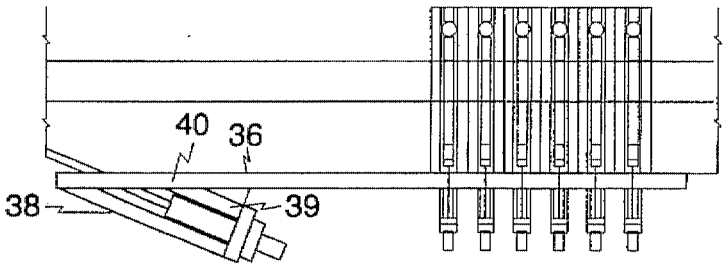
FIGS. 17A, 17B, 17C and 17D are respectively side elevational, front elevational, bottom plan and top plan views of a lower inclined friction connector for use with a lower bulb-type flange of a girder.
Figure 17B:
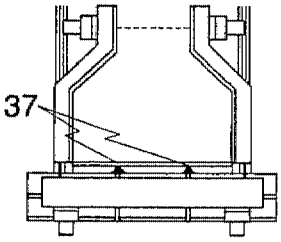
Figure 17C:
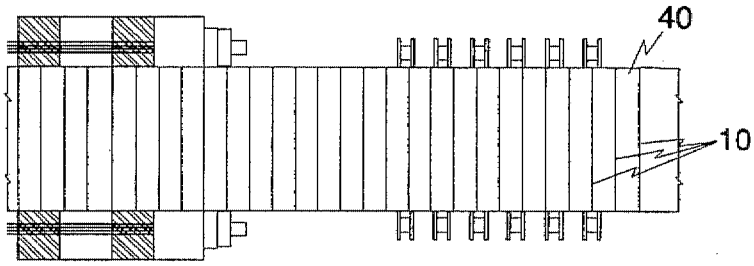
Figure 17D:
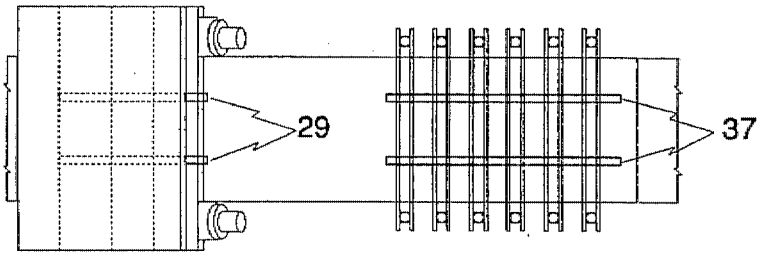

The friction connectors 65 are preferably built as shown in FIGS. 15 and 16, wherein it is shown that said connectors generally comprise a friction plate 7 of a rectangular shape and with a construction similar to the friction plates 1 described above. Said friction plate 7 is provided with a pair of perpendicular rectangular supporting plates 8 attached to the side edges thereof and a number of intermediate supporting plates 9 between the supporting plates 8, the number of said intermediate supporting plates 9 depending on the number of tendons 61 to be incorporated in the system as more clearly shown in FIG. 15D. At the front end of the friction connector, a pair of transverse sole plates 11 are placed and, between said sole plates the necessary number of square plates 12 is attached for fixing the position of the ends 41 of the tendons 61 by means of respective nuts 42. Said square plates 12 are provided with a center bore (not shown) similar to bore 4 of the plates 3 described above.

In order to press the above mentioned structure against the bottom of the flange 55 of the girder, a plurality of transverse pressing members 13 built with a pair of parallel sole plates 14 joined by means of small plates 15. Said pressing members 13 are provided with stop plates 16, as more clearly shown in FIG. 20, with a hole 17 to permit the passage and fixation of suitable fasteners which are preferably provided as more clearly shown in FIG. 21, in the form of a piece of steel stranded cable 19 having at its upper end an anchoring barrel 22 fixed by means of wedges 23 to the cable 19 and at it lower end a threaded anchoring barrel 20 similar to barrel 22 which is fixed against the stop plates 16 by means of suitable nuts 21 thus forming a bolt and nut assembly 20, 21. The length of the anchoring barrel 20 must be of a length sufficient to accommodate the hydraulic tensing bar normally used for tensing the device. The assembly is complemented by a plurality of upper supports 24 which adopt the shape of the lower flange 51 of the girder as it may be seen comparing FIGS. 15 and FIGS. 16. FIG. 18 shows in more detail a support 24 used in connection with bulb-type and semibulb-type flanges which comprises a pair of parallel plates 25, which follow the contour of the girder flange and are perpendicular to the surface of said flange, joined by means of an upper plate 26 parallel to the surface of the girder web and provided with a hole 27 for passing the bolts or cables 19 for pressing against said web by means of the already described bolt and nut assemblies 20, 21, and a lower horizontal plate 28, also bored, which serves to support the upper end of the fasteners The pressing members used with T type beams and the like are preferably built as shown in FIG. 19. These pressing members which do not count with the support provided by a bulb-type flange, must be built with a friction plate 29 having friction ribs 30 for enhancing the friction connection. These pressing members are otherwise similar to the pressing members 24 described above and comprise the pair of parallel plates 31 or a straight shape, connected by means of a plurality of plates 32 with holes 33 for pressing against the web and flange of the girder, and a lower stop plate 35 similar to plate 28 described above.

All the friction joints formed by the friction connectors used in accordance with the present invention are provided with the above described layer of mortar, designated by means of the reference numeral 36, for producing a joint acting exclusively by friction forces.

The inclined friction connectors 67 used in the embodiment shown in FIG. 3 of the drawings is more clearly illustrated in FIG. 17. These friction connectors are similar in their construction to the friction connectors described in connection with figures 16 to 19 but omitting the lower box formed by the supporting plates 8 and 9. However as already mentioned above this box may be included in the connectors in order to provide for independent tensioning of the inclined and the horizontal tendons. The friction plate 40 in this case is an elongated plate in order to accommodate in its front end, an inclined anchoring member formed by parallel plates 38 and 39, interiorly reinforced with parallel intermediate plates 29, in order to serve as anchoring members for the lower ends of the tendons, as more clearly shown in FIG. 17D.

FIGS. 22 to 26 illustrate the preferred construction of the guide-type friction connectors 58 shown in FIG. 1, for use with different types of girders. The guide-type friction connector 58 comprises a box type beam 43 having side plates 44 extending vertically upwardly of box 43. A guide block 60 is attached to each one of plates said guide comprising an upper reinforcing plate 46 and a solid member 45 having a lower surface cylindrically curved for guiding the tendons as already described above. A vertical stop plate 46 is provided on the outer surface of solid member 45 projecting outwardly of the curved surface, to serve as a stop to prevent the tendons from sliding outwardly of the device. The contact or friction plate of the box 43, as more clearly shown in FIG. 22C, is provided with the already described ribs that in this embodiment are designated by the numeral 48. Mounting screws 47 are also shown in this figure, which are provided with sharp pointed ends to penetrate the concrete during mounting of the tendons.

As shown in FIGS. 23 and 24, when the lower flange of the girder is not of the bulb type, a filling box 51 must be inserted to compensate for the reduced thickness of the girder.

FIG. 25 shows in detail a preferred type of tension member or tendon 61, which comprises a plurality of stranded cables forming a bundle 40, connected by means of a conventional extrusion process, to anchors 41 on each end thereof, said anchors having a threaded head to accommodate a nut 42 for fixation thereof in any one of the friction connectors of the system in accordance with the present invention.

Although certain specific embodiments of the present invention have been shown and described above, it is to be understood that many modifications thereof are possible. The present invention, therefore is not to be restricted except insofar as is necessitated by the prior art and by the spirit of the appended claims.

What is claimed is:

1. A method of externally reinforcing a girder for increasing the load bearing capacity thereof, said girder comprising first and second ends, a web, an upper or compression flange, and a lower or tension flange, each of said web and said flanges having first and second opposing faces such that said girder has first and second opposing faces, said method comprising the steps of:

attaching exclusively by friction forces to each one of said faces of said web at said first end of said girder a first upper friction connector below said upper flange and extending in a downward direction towards a center of the length of the girder;

attaching exclusively by friction forces to each one of said faces of said web at said second end of said girder a second upper friction connector below said upper flange and extending in a downward direction towards the center of the length of the girder;

attaching exclusively by friction forces to each one of said faces of said lower flange first and second lower friction connectors, said first lower friction connector being collinearly arranged with respect to said first upper friction connector, said second lower friction connector being collinearly arranged with respect to said second upper friction connector, and said first and second lower friction connectors being collinearly arranged with and spaced apart from each other;

passing a tension member through said first upper friction connector, said first lower friction connector, said second lower friction connector, and said second upper friction connector on each face of said girder, thereby forming a first tension member stretch extending in a downwardly inclined direction between said first upper friction connector and said first lower friction connector, a second tension member stretch extending in a horizontal direction between said first and second lower friction connectors, and a third tension member stretch extending in an upwardly inclined direction between said second lower friction connector and said second upper friction connector; and tensioning at least one of said tension member stretches sufficiently to transmit, exclusively by means of friction forces, the required forces to said girder in order to increase the load bearing capacity thereof;

wherein said steps of attaching exclusively by friction forces to each one of said faces of said web first and second upper friction connectors and first and second lower friction connectors include the steps of sufficiently pressing said friction connectors on said first face of said girder against said first face of said girder and sufficiently pressing said friction connectors on said second face of said girder against said second face of said girder to cause the vertical forces maintaining said friction connectors in place against said faces of said girder to be provided exclusively by friction.

2. A method of externally reinforcing a girder as in claim 1, wherein:

said first and second upper friction connectors are anchoring devices for ends of said tension member; and said first and second lower friction connectors are guide-type friction connectors for guided passaging of said tension member therethrough.

3. A method as in claim 2, wherein:

said first, second, and third tension member stretches are provided as a continuous tension member; and said method further comprises the step of simultaneously tensioning said first, second, and third tension member stretches.

4. A method of externally reinforcing a girder as in claim 2, wherein said guide-type friction connectors each comprise a guiding block having a curved guiding surface arranged to guide said tension member under said guiding block to deflect said tension member from said inclined direction to said horizontal direction and from said horizontal direction to said inclined direction.

5. A method of externally reinforcing a girder as in claim 4, wherein said guiding block of each of said guide-type friction connectors further comprises a stop plate attached to an outer surface of said guiding block and having a curved edge which projects beyond the curved guiding surface of said guiding block in order to form a channel to prevent dislodging of said continuous tension member from said guiding block.

6. A method of externally reinforcing a girder as in claim 1, wherein:

said first, second, and third tension stretches are provided as separate tension members including a first tension member extending in a downwardly inclined direction between said first upper friction connector and said first lower friction connector, a second tension member tending horizontally between said first and second lower friction connectors, and a third tension member extending in an upwardly inclined direction between said second lower friction connector and said second upper friction connector;

each of said friction connectors are provided in the form of anchoring devices for ends of each one of said first, second, and third tension members; and said method further comprises the step of independently tensioning each of said first, second, and third tension members to thereby provide different tension stresses in the inclined and in the horizontal directions of said girder.

7. A method of externally reinforcing a girder as in claim 6, wherein only said first and third tension members are tensioned under equal tension stresses in order to increase the strength of the girder to shearing stresses without increasing the strength of the girder to bending stresses.

8. A method of externally reinforcing a girder as in claim 6, wherein only said second tension member is tensioned in order to increase the strength of the girder to bending stresses without increasing the strength of the girder to shearing stresses.

9. A method of reinforcing a girder as in claim 1, wherein each of said friction connectors include at least one friction connecting plate having a shape complementary to the shape of a portion of the girder on which said friction connector is to be placed; and said friction connectors are fixed to the respective surfaces of said girder by pressing said at least one friction connecting plate against said surface of said girder with sufficient force to transmit to said girder exclusively by friction forces the tension stresses applied to said tension member stretches.

10. A method of externally reinforcing a girder as in claim 9, wherein said friction connecting plate has a roughened surface facing said girder, and said girder has a complementary roughened surface facing said roughened surface of said friction connecting plate, said complementary roughened surfaces increasing the friction connecting force therebetween.

11. A method of externally reinforcing a girder as in claim 10, wherein said roughened surface of said connecting plate is roughened by providing a plurality of ribs perpendicularly extending in the direction of the force applied by said tension member, and said roughened complementary surfaces of said girder are roughened by bushhammering.

12. A method of externally reinforcing a girder as in claim 11, further including the step of placing a layer of high resistance expansive hydraulic mortar between at least one of said friction connecting plates and a complementary surface of said girder to thereby increase the friction force therebetween.

13. A method of externally reinforcing a girder as in claim 9, wherein said pressing of said at least one friction connecting plate against said surface of said girder on each said face of said girder is effected by nut and bolt assemblies extending perpendicularly to and between the said friction connecting plates.

14. A method of externally reinforcing a girder as in claim 1, wherein said first and second upper friction connectors and said first and second lower friction connectors are fastened to said girder by means of bolt and nut assemblies, said nut and bolt assemblies pressing said connectors against said faces of said girder to maintain said girders in place against said faces of said girder exclusively by friction.

15. A method of externally reinforcing a continuous beam having one support at each end and a plurality of intermediate supports forming corresponding beam spans therebetween, each of said beam spans comprising first and second ends, a web, an upper or compression flange, and a lower or tension flange, each of said web and said flanges having first and second opposing faces such that each of said beam spans has first and second opposing faces, said method comprising the steps of:

attaching exclusively by friction forces to each of said faces of said webs at said first end of each of said beam spans a first upper friction connector below said upper flange and extending in a downward direction towards a center of the length of the beam span, attaching exclusively by friction forces to each of said faces of said webs at said second end of each of said beam spans a second upper friction connector below said upper flange and extending in a downward direction towards the center of the length of the beam span;

attaching exclusively by friction forces to each one of said faces of said lower flanges of each of said beam spans first and second lower friction connectors, said first lower friction connector of each respective beam span being collinearly arranged with respect to said first upper friction connector of said beam span, said second lower friction connector of each respective beam span being collinearly arranged with respect to said second upper friction connector of said respective beam span, and said first and second lower friction connectors being collinearly arranged with and spaced apart from each other;

passing a first tension member through said first upper friction connector, said first lower friction connector, said second lower friction connector, and said second upper friction connector on each face of each of said beam spans, thereby forming a first tension member stretch extending in a downwardly inclined direction between said first upper friction connector and said first lower friction connector, a second tension member stretch extending in a horizontal direction between said first and second lower friction connectors, and a third tension member stretch extending in an upwardly inclined direction between said second lower friction connector and said second upper friction connector;

tensioning at least one of said first, second, and third tension member stretches sufficiently to transmit, exclusively by means of friction forces, the required forces to said continuous beam in order to increase the load bearing capacity thereof;

attaching exclusively by friction forces to each one of said faces of each of said beam spans having the second end adjacent said first end of the another beam span a first horizontal friction connector adjacent said upper flange and at a predetermined distance from said second end of said beam span;

attaching exclusively by friction forces to each one of said faces of each of said beam spans having the first end adjacent said second end of the another beam span a second horizontal friction connector adjacent said upper flange and at a predetermined distance from said first end of said beam span;

passing a second tension member through adjacent first and second horizontal friction connectors of adjacent beam spans such that each intermediate support of said continuous beam is located at the midpoint of said second tension member; and tensioning said second tension member with a stress sufficient to compensate for negative bending stresses applied to said continuous beam by said intermediate supports;

wherein said steps of attaching exclusively by friction forces to each one of said faces of said web first and second upper friction connectors, first and second lower friction connectors, and said first and second horizontal friction connectors include the steps of sufficiently pressing said friction connectors on said first face of each said beam span against said first face of each said beam span and sufficiently pressing said friction connectors on said second face of each said beam span against said second face of each said beam span to cause the vertical forces maintaining said friction connectors in place against said faces of said beam span to be provided exclusively by friction.

16. A method as in claim 15, wherein said first and second horizontal friction connectors are provided in the form of anchoring devices for the ends of each of said second tension members.

17. A method of externally reinforcing a girder for increasing the load bearing capacity thereof, said girder comprising first and second ends, a web, an upper or compression flange, and a lower or tension flange, each of said web and said flanges having substantially parallel first and second opposing substantially vertical faces such that said girder has first and second opposing faces, said method comprising the steps of:

attaching exclusively by friction forces to each one of said faces of said lower flange at said first end of said girder a first lower friction connector;

attaching exclusively by friction forces to each one of said faces of said lower flange at said second end of said girder a second lower friction connector, said first and second lower friction connectors being collinearly arranged with and spaced apart from each other;

passing a tension member extending horizontally through said first and second lower friction connectors on each face of said girder; and tensioning said tension members sufficiently to transmit, exclusively by means of friction forces, the required forces to said girder in order to increase the load bearing capacity thereof;

wherein said steps of attaching exclusively by friction forces to each one of said faces of said girder first and second lower friction connectors include the steps of sufficiently pressing said friction connectors on said first face of said girder against said first face of said girder and sufficiently pressing said friction connectors on said second face of said girder against said second face of said girder to cause the forces maintaining said friction connectors in place against said faces of said girder to be provided exclusively by friction.

18. A method of externally reinforcing a girder according to claim 17, wherein each of said lower friction connectors comprises an anchoring device for fastening ends of each of said tension members.

19. A method of eternally reinforcing a girder as in claim 17, wherein said first and second lower friction connectors are fastened to said girder by means of bolt and nut assemblies, said nut and bolt assemblies pressing said connectors against said faces of said girder to maintain said girders in place against said faces of said girder exclusively by friction.

20. A method of externally reinforcing a girder for increasing the load bearing capacity thereof, said girder comprising first and second ends, a web, an upper or compression flange, and a lower or tension flange, each of said web and said flanges having first and second opposing faces such that said girder has first and second opposing faces, said method comprising the steps of:

attaching exclusively by friction forces to each one of said faces of said web at said first end of said girder a first upper friction connector below said upper flange and extending in a downward direction towards a center of the length of the girder;

attaching exclusively by friction forces to each one of said faces of said web at said second end of said girder a second upper friction connector below said upper flange and extending in a downward direction towards the center of the length of the girder;

attaching exclusively by friction forces, to each one of said faces of said lower flange, first and second lower friction connectors, said first lower friction connector being collinearly arranged with respect to said first upper friction connector, said second lower friction connector being collinearly arranged with respect to said second upper friction connector, and said first and second lower friction connectors being spaced apart from each other;

passing a first tension member through said first upper friction connector and said first lower friction connector on each face of said girder, and passing a second tension member through said second upper friction connector and said second lower friction connector on each face of said girder, thereby forming a first tension member stretch extending in a downwardly inclined direction between said first upper friction connector and said first lower friction connector, and a second tension member stretch extending in a downwardly inclined direction between said second upper friction connector and said second lower friction connector; and tensioning at least one of said tension member stretches sufficiently to transmit, exclusively by means of friction forces, the required forces to said girder in order to increase the load bearing capacity thereof;

wherein said steps of attaching exclusively by friction forces to each one of said faces of said girder first and second upper friction connectors and first and second lower friction connectors include the steps of sufficiently pressing said friction connectors on said first face of said girder against said first face of said girder and sufficiently pressing said friction connectors on said second face of said girder against said second face of said girder to cause the forces maintaining said friction connectors in place against said faces of said girder to be provided exclusively by friction.

21. A method of externally reinforcing a girder according to claim 20, wherein each of said upper and lower friction connectors comprises an anchoring device for fastening the ends of each one of said tension member stretches, to thereby permit the independent tensioning of each one of said tension member stretches in order to provide selected different required forces in different sections of the girder.

22. A method of externally reinforcing a girder as in claim 20, wherein said first and second upper friction connectors and said first and second lower friction connectors are fastened to said girder by means of bolt and nut assemblies, said nut and bolt assemblies pressing said connectors against said faces of said girder to maintain said girders in place against said faces of said girder exclusively by friction.

* * * * *